US008195069B2

(12) United States Patent
Handa et al.

(10) Patent No.: US 8,195,069 B2
(45) Date of Patent: Jun. 5, 2012

(54) DEVELOPING CARTRIDGE FOR IMAGE-FORMING DEVICE AND METHOD OF MANUFACTURING THE SAME

(75) Inventors: Hiroshi Handa, Nagoya (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 392 days.

(21) Appl. No.: 12/606,589

(22) Filed: Oct. 27, 2009

(65) Prior Publication Data

US 2010/0104327 A1 Apr. 29, 2010

(30) Foreign Application Priority Data

Oct. 29, 2008 (JP) ..... 2008-277806

(51) Int. Cl.
*G03G 15/08* (2006.01)

(52) U.S. Cl. ..... 399/262; 399/111; 399/109; 399/263; 399/119

(58) Field of Classification Search ..... 399/111, 399/109, 262–263, 119
See application file for complete search history.

(56) References Cited

U.S. PATENT DOCUMENTS

| | | | | |
|---|---|---|---|---|
| 5,966,568 | A | 10/1999 | Numagami et al. | |
| 6,782,221 | B2 | 8/2004 | Saito et al. | |
| 7,398,039 | B2 | 7/2008 | Ishii | |
| 2006/0029421 | A1 * | 2/2006 | Ishii et al. | 399/111 |

FOREIGN PATENT DOCUMENTS

| | | |
|---|---|---|
| JP | 03-327801 | 9/2002 |
| JP | 2004-101757 | 4/2004 |
| JP | 2006-053322 | 2/2006 |
| JP | 2008-058469 | 3/2008 |

* cited by examiner

*Primary Examiner* — David Gray
*Assistant Examiner* — G. M. Hyder
(74) *Attorney, Agent, or Firm* — Banner & Witcoff, Ltd.

(57) ABSTRACT

A developing cartridge includes: a casing configured of a first frame and a second frame with a space formed therebetween; and a developer-carrying member that is supported in the first frame and that is configured to carry developer. The first frame includes a bottom wall and a pair of side walls erected from both sides of the bottom wall and has a box shape that is open on a side opposite the bottom wall. The second frame is mounted over the pair of side walls so as to cover the open side of the first frame and has a partition extending into the space formed in the casing. The partition contacts the bottom wall of the first frame and spans between the pair of side walls of the first frame, thereby separating the space within the casing into a first chamber on a side near the developer-carrying member and a second chamber on a side far from the developer-carrying member. Developer is accommodated in the first chamber only.

17 Claims, 11 Drawing Sheets

DEVELOPING CARTRIDGE FOR IMAGE-FORMING DEVICE AND METHOD OF MANUFACTURING THE SAME

CROSS REFERENCE TO RELATED APPLICATION

This application claims priority from Japanese Patent Application No. 2008-277806 filed Oct. 29, 2008. The entire content of each of these priority applications is incorporated herein by reference.

TECHNICAL FIELD

The present invention relates to a developing cartridge, a process cartridge, an image-forming device, and a method of manufacturing the developing cartridge.

BACKGROUND

One type of electrophotographic image-forming device known in the art is a laser printer having a process cartridge detachably mounted in the body thereof. The process cartridge has a drum cartridge provided with a photosensitive drum for carrying an image thereon, and a developing cartridge that is detachably mounted on the drum cartridge. With this configuration, the developing cartridge and the drum cartridge can be replaced individually when necessary, which from a cost perspective is more advantageous than replacing the cartridges as a unit.

The developing cartridge includes a toner-accommodating chamber that holds toner, and a developing chamber that communicates with the toner-accommodating chamber via a toner supply opening. An agitator provided in the toner-accommodating chamber expels toner from the toner-accommodating chamber into the developing chamber via the toner supply opening. A supply roller, developing roller, and the like are also provided in the developing chamber. The supply roller rotates to supply toner in the developing chamber onto the developing roller. The developing roller then supplies the toner onto the photosensitive drum in order to form a toner image thereon.

The toner image formed on the photosensitive drum is subsequently transferred onto a sheet of paper conveyed through the laser printer, and a fixing unit provided in the body of the laser printer fixes the toner image to the paper, thereby completing the image-forming operation.

There are also various types of developing cartridges that accommodate different quantities of toner. More specifically, there are one type of developing cartridge, in which a maximum amount of toner is accommodated, and another type of developing cartridge, in which a smaller amount of toner is accommodated.

SUMMARY

It is an object of the present invention to provide a developing cartridge, a process cartridge, an image-forming device, and a method of manufacturing the developing cartridge which can quickly supply toner to a developer-carrying member regardless of the amount of toner accommodated in the developing cartridge.

In order to attain the above and other objects, the invention provides a developing cartridge including: a casing configured of a first frame and a second frame with a space formed therebetween; and a developer-carrying member that is supported in the first frame and that is configured to carry developer. The first frame includes a bottom wall and a pair of side walls erected from both sides of the bottom wall and has a box shape that is open on a side opposite the bottom wall. The second frame is mounted over the pair of side walls so as to cover the open side of the first frame and has a partition extending into the space formed in the casing. The partition contacts the bottom wall of the first frame and spans between the pair of side walls of the first frame, thereby separating the space within the casing into a first chamber on a side near the developer-carrying member and a second chamber on a side far from the developer-carrying member. Developer is accommodated in the first chamber only.

According to another aspect, the present invention provides a process cartridge, including: an image cartridge; an image-carrying member; and either one of a first developing cartridge and a second developing cartridge. The image-carrying member is mounted in the image cartridge and is configured so as to be capable of carrying an electrostatic latent image. Each of the first developing cartridge and the second developing cartridge has a developer-carrying member that is configured so as to be capable of supplying a developer to the image-carrying member. The either one of the first developing cartridge and the second developing cartridge is selectively and detachably mounted on the image cartridge so that the developer-carrying member confronts the image-carrying member. The first developing cartridge has a first casing. The second developing cartridge has a second casing. Each of the first casing and the second casing defines a space therein, the space having a first chamber and a second chamber. Each of the first casing and the second casing includes a first frame. The first frame includes a bottom wall and a pair of side walls erected from both sides of the bottom wall and having a box shape that is open on a side opposite the bottom wall. The developer-carrying member is supported by the first frame and is located in the first chamber. The first casing further includes a second frame. The second frame is mounted over the pair of side walls so as to cover the open side of the first frame and has a partition extending into the space. The partition contacts the bottom wall of the first frame and separates the first chamber from the second chamber. Developer is accommodated in only the first chamber among the first chamber and the second chamber of the first casing. The second casing further includes a third frame mounted over the pair of side walls of the first frame to cover the open side of the first frame and to allow communication between the first chamber and the second chamber. Developer is accommodated in both of the first chamber and the second chamber of the second casing. The second developing cartridge further includes an agitating member that is provided in the second chamber of the second casing and that is configured so as to be capable of supplying developer from the second chamber to the first chamber.

According to another aspect, the present invention provides an image-forming device including: an image-forming device housing; a light-emitting element; a light-receiving element; an image-carrying member; and either one of a first developing cartridge and a second developing cartridge. The light-emitting element is mounted in the image-forming device housing and is configured to emit a sensor light beam. The light-receiving element is mounted in the image-forming device housing and is configured to receive the sensor light beam, an optical path of the sensor light beam being defined between the light-emitting element and light-receiving element. The image-carrying member is mounted in the image-forming device housing and is configured so as to be capable of carrying an electrostatic latent image thereon. The either one of the first developing cartridge and the second developing cartridge is selectively mounted in the image-forming device at a position intersecting with the optical path of the sensor light beam. Each of the first developing cartridge and the second developing cartridge is configured to accommodate developer therein and includes a developer-carrying member that is configured so as to be capable of being disposed in confrontation with the image-carrying member and supplying developer to the image-carrying member. The first developing cartridge has a first casing. The second developing cartridge has a second casing. Each of the first casing and the second casing defines a space therein, the space having a first chamber and a second chamber. Each of the first casing and the second casing includes a first frame, the first frame including a bottom wall and a pair of side walls erected from both sides of the bottom wall and having a box shape that is open on a side opposite the bottom wall, the developer-carrying member being supported by the first frame and being located in the first chamber, a residual developer quantity detection window being formed through the first frame at a location forming the second chamber, the sensor light beam emitted from the light-emitting element reaching the residual developer quantity detection window when the each of the first and second developing cartridges is mounted in the image forming device. The first casing further includes a second frame that is mounted over the pair of side walls so as to cover the open side of the first frame and that has a partition extending into the space, the partition contacting the bottom wall of the first frame and separating the first chamber from the second chamber, developer being accommodated in only the first chamber among the first chamber and the second chamber of the first casing, a light-shielding member extending from the second frame to block the sensor light beam from reaching the light-receiving element. The second casing further includes a third frame mounted over the pair of side walls of the first frame to cover the open side of the first frame and to allow communication between the first chamber and the second chamber, developer being accommodated in both of the first chamber and the second chamber of the second casing.

According to another aspect, the present invention provides a method of manufacturing a selected one of a first developing cartridge and a second developing cartridge that can be selectively and detachably mounted in an image forming device, an image-carrying member being mounted in the image-forming device and that is configured so as to be capable of carrying an electrostatic latent image thereon, each of the first developing cartridge and the second developing cartridge being configured to accommodate developer therein and including a developer-carrying member that, when the each of the first developing cartridge and the second developing cartridge is mounted in the image-forming device, is disposed in confrontation with the image-carrying member and is configured so as to be capable of supplying developer to the image-carrying member, the first developing cartridge having a first casing, the second developing cartridge having a second casing, each of the first casing and the second casing defining a space therein, the space having a first chamber and a second chamber, each of the first casing and the second casing including a first frame, the first frame including a bottom wall and a pair of side walls erected from both sides of the bottom wall and having a box shape that is open on a side opposite the bottom wall, the developer-carrying member being supported by the first frame and being located in the first chamber, the first casing further including a second frame that is mounted over the pair of side walls so as to cover the open side of the first frame and that has a partition extending into the space, the partition contacting the bottom wall of the first frame and separating the first chamber from the second chamber, developer being accommodated in only the first chamber among the first chamber and the second chamber of the first casing, the second casing further including a third frame mounted over the pair of side walls of the first frame to cover the open side of the first frame and to allow communication between the first chamber and the second chamber, developer being accommodated in both of the first chamber and the second chamber of the second casing. The manufacturing method includes: mounting the developer-carrying member on the first frame; mounting a selected one of the second frame and the third frame on the first frame; and introducing developer into the first chamber when the second frame is mounted on the first frame, thereby producing the first developing cartridge, and introducing developer into the second chamber when the third frame is mounted on the first frame, thereby producing the second developing cartridge.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, a laser printer according to an embodiment of the present invention will be described while referring to the accompanying drawings.

The terms “upward”, “downward”, “upper”, “lower”, “above”, “below”, “beneath”, “right”, “left”, “front”, “rear” and the like will be used throughout the description assuming that the laser printer is disposed in an orientation in which it is intended to be used. In use, the laser printer is disposed as shown in FIG. 1.

Figure 1:
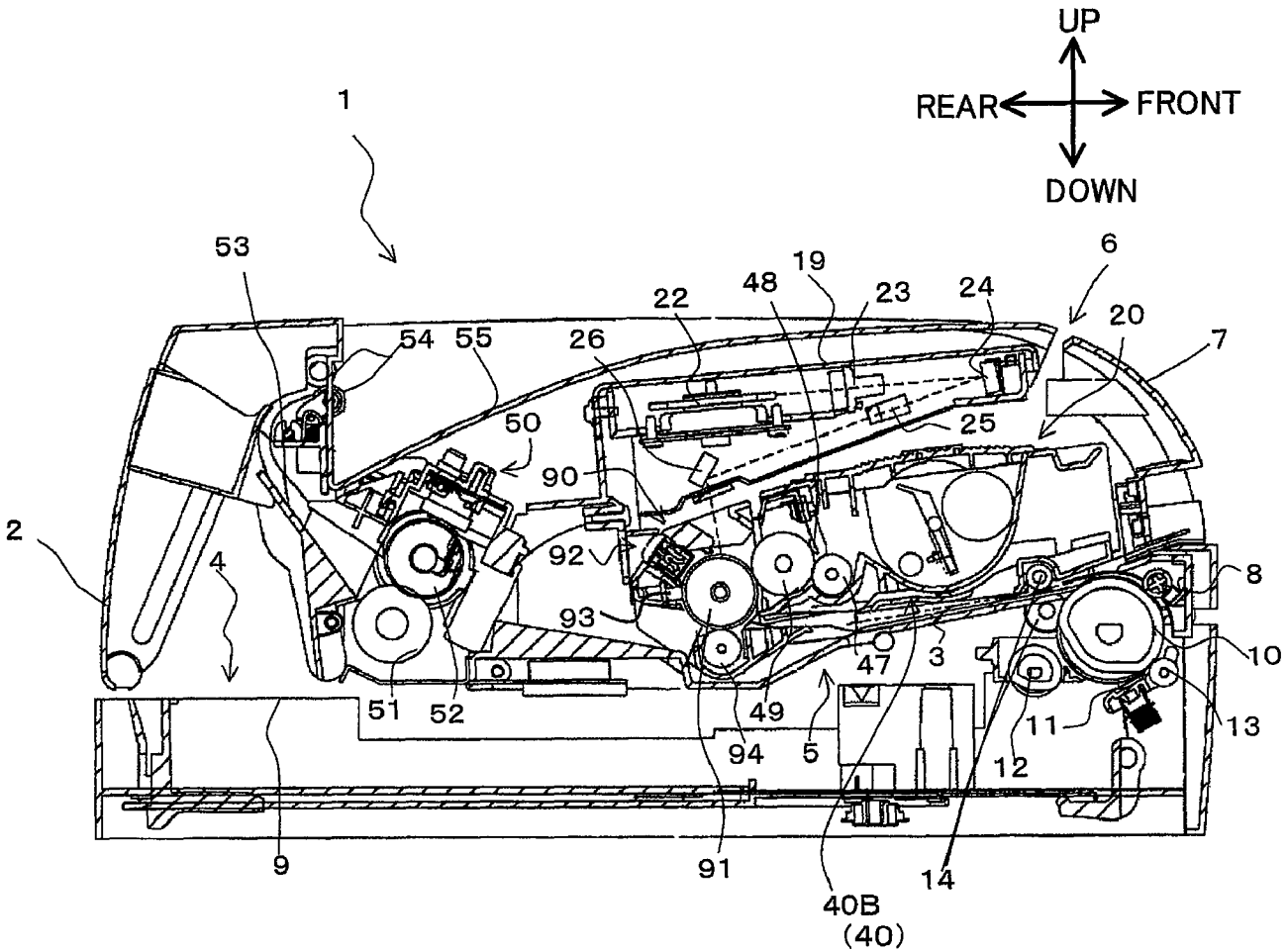
FIG. 1 is a cross-sectional side view of a laser printer according to an embodiment of the present invention.

As shown in FIG. 1, the laser printer 1 includes a main casing 2 and, accommodated in the main casing 2, a feeding unit 4 for supplying a sheet of paper 3 for a printing operation, and an image-forming unit 5 for forming an image on the sheet of paper 3 supplied by the feeding unit 4. In the following description, the top, bottom, front, and rear sides of the laser printer 1 will be defined as they are shown in FIG. 1. Likewise, the right side of the laser printer 1 will be defined as the far side in FIG. 1, and the left side as the near side in FIG. 1.

Figure 2:
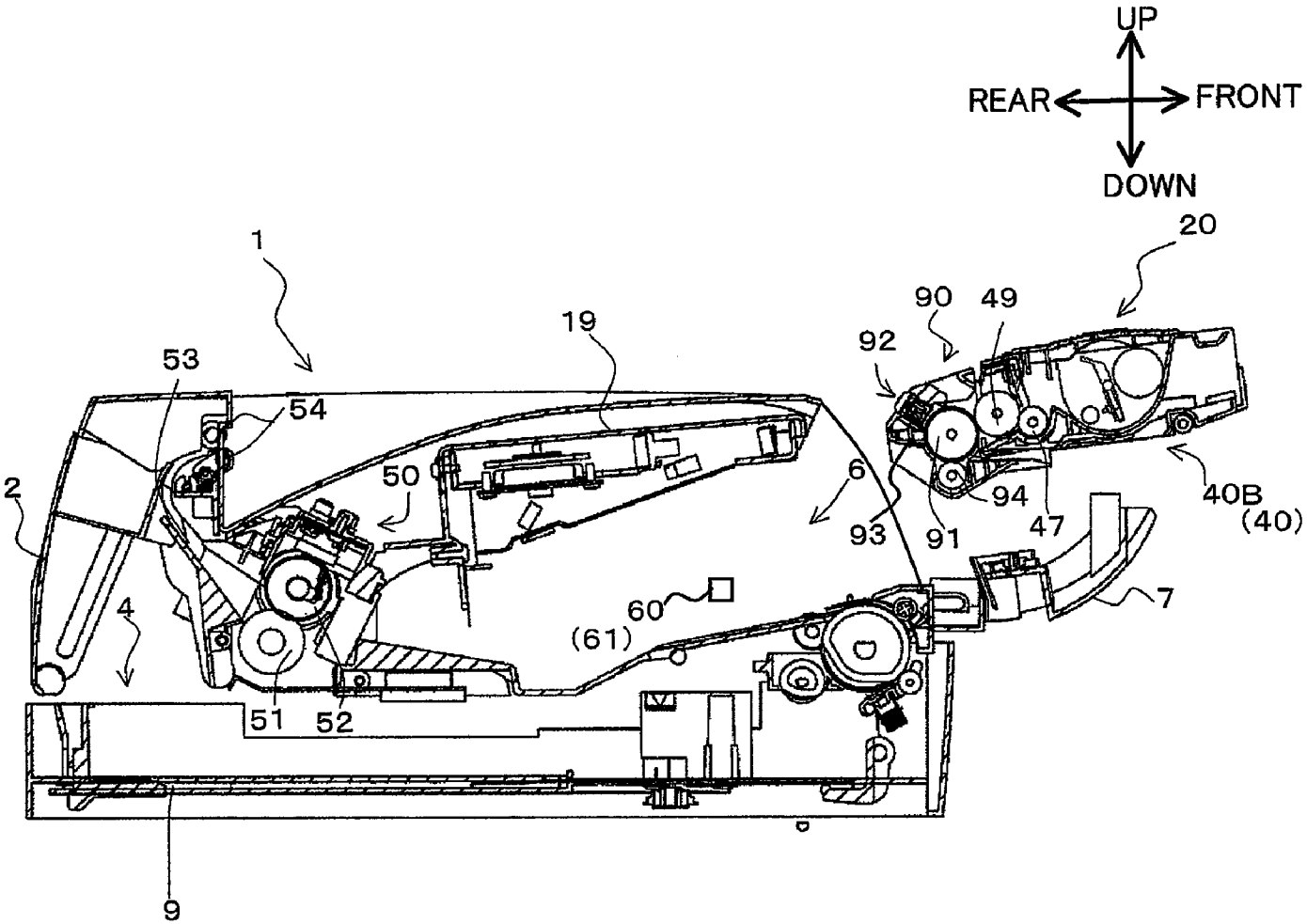
FIG. 2 is a cross-sectional side view of the laser printer in a state where a process cartridge is detached from the laser printer.

A cartridge access opening 6 is formed in the front side of the main casing 2 for mounting and removing a process cartridge 20. A front cover 7 is provided on the front side for covering or exposing the cartridge access opening 6. The front cover 7 is rotatably supported about a cover shaft (not shown) and can be rotated open to expose the cartridge access opening 6, as shown in FIG. 2. At this time, the process cartridge 20 can be mounted in or removed from the main casing 2 through the cartridge access opening 6.

As shown in FIG. 2, a light-receiving element 60 is mounted on the inner side surface of a right side wall of the main casing of the laser printer 1. Although not shown in the drawing, a light-emitting element 61 is mounted on the inner side surface of a left side wall of the main casing of the laser printer 1. The light-receiving element 60 and light-emitting element 61 are distant from each other in the right-to-left direction and oppose with each other when the process cartridge 20 is not mounted in the laser printer 1. The light-emitting element 61 is for emitting a sensor light beam so that the sensor light will travel along an optical path that extends parallel with the right-to-left direction of the laser printer 1, and reach the light-receiving element 60. The light-receiving element 60 is for receiving the sensor light and for outputting a signal indicative of the received sensor light. The light-receiving element 60 and the light-emitting element 61 will face the right and left sides, respectively, of the process cartridge 20 when the process cartridge 20 is mounted in the laser printer 1. So, when the process cartridge 20 is mounted in the laser printer 1, the process cartridge 20 intersects with the optical path of the sensor light beam that travels from the light-emitting element 61 toward the light-receiving element 60.

The feeding unit 4 includes a paper tray 9 detachably mounted in the bottom section of the main casing 2, a feeding roller 10 and a separating pad 11 disposed above the front end of the paper tray 9, a pickup roller 12 disposed on the rear side of the feeding roller 10, a pinch roller 13 disposed in opposition to the lower front side of the feeding roller 10, a paper dust roller 8 disposed in opposition to the upper front side of the feeding roller 10, and registration rollers 14 disposed on the upper rear side of the feeding roller 10.

Sheets of paper 3 are stacked and accommodated in the paper tray 9. The pickup roller 12 rotates to pick up and supply sheets to the feeding roller 10 and separating pad 11, and the feeding roller 10 and separating pad 11 separate and feed these sheets one at a time to the image-forming unit 5 via the pinch roller 13 and registration rollers 14.

The image-forming unit 5 includes a scanning unit 19, the process cartridge 20, and a fixing unit 50.

The scanning unit 19 is disposed in the top section of the main casing 2 and includes a laser light source (not shown), a polygon mirror 22 that is driven to rotate, an fθ lens 23, a reflecting mirror 24, a lens 25, and a reflecting mirror 26.

The laser light source emits a laser beam based on image data. As indicated by the dashed line, the laser beam is deflected off the polygon mirror 22 to pass through the fθ lens 23, is subsequently reflected by the reflecting mirror 24 along an optical path that passes through the lens 25, and is subsequently reflected onto a downward optical path by the reflecting mirror 26 so as to irradiate the surface of a photosensitive drum 91 described later in the process cartridge 20.

The process cartridge 20 is detachably mounted in the main casing 2 beneath the scanning unit 19.

The process cartridge 20 includes a drum cartridge 90. The drum cartridge 90 is provided with the photosensitive drum 91, a Scorotron charger 92, a transfer roller 94, and a cleaning brush 93.

The process cartridge 20 further includes a developing cartridge 40 that is detachably mounted on the drum cartridge 90. The developing cartridge 40 accommodates toner therein and is for supplying toner to the photosensitive drum 91.

There are two types of developing cartridges 40, that is, a normal cartridge 40B and a starter cartridge 40A. One of the normal cartridge 40B and the starter cartridge 40A can be selectively mounted on the drum cartridge 90. FIGS. 1 and 2 show the state where the normal cartridge 40B is mounted on the drum cartridge 90. The starter cartridge 40A is pre-mounted in the laser printer 1 when the printer 1 is shipped from a factory where the laser printer 1 is manufactured. More specifically, the starter cartridge 40A is sold as an accessory to the laser printer 1, and therefore is packaged and shipped with the laser printer 1. The normal cartridge 40B is used as a replacement to the factory-mounted, starter cartridge 40A, and therefore is a commercial product that is sold as a replacement developing cartridge separately from the laser printer 1. The normal cartridge 40B accommodates a larger quantity of toner than the starter cartridge 40A.

Figure 3:
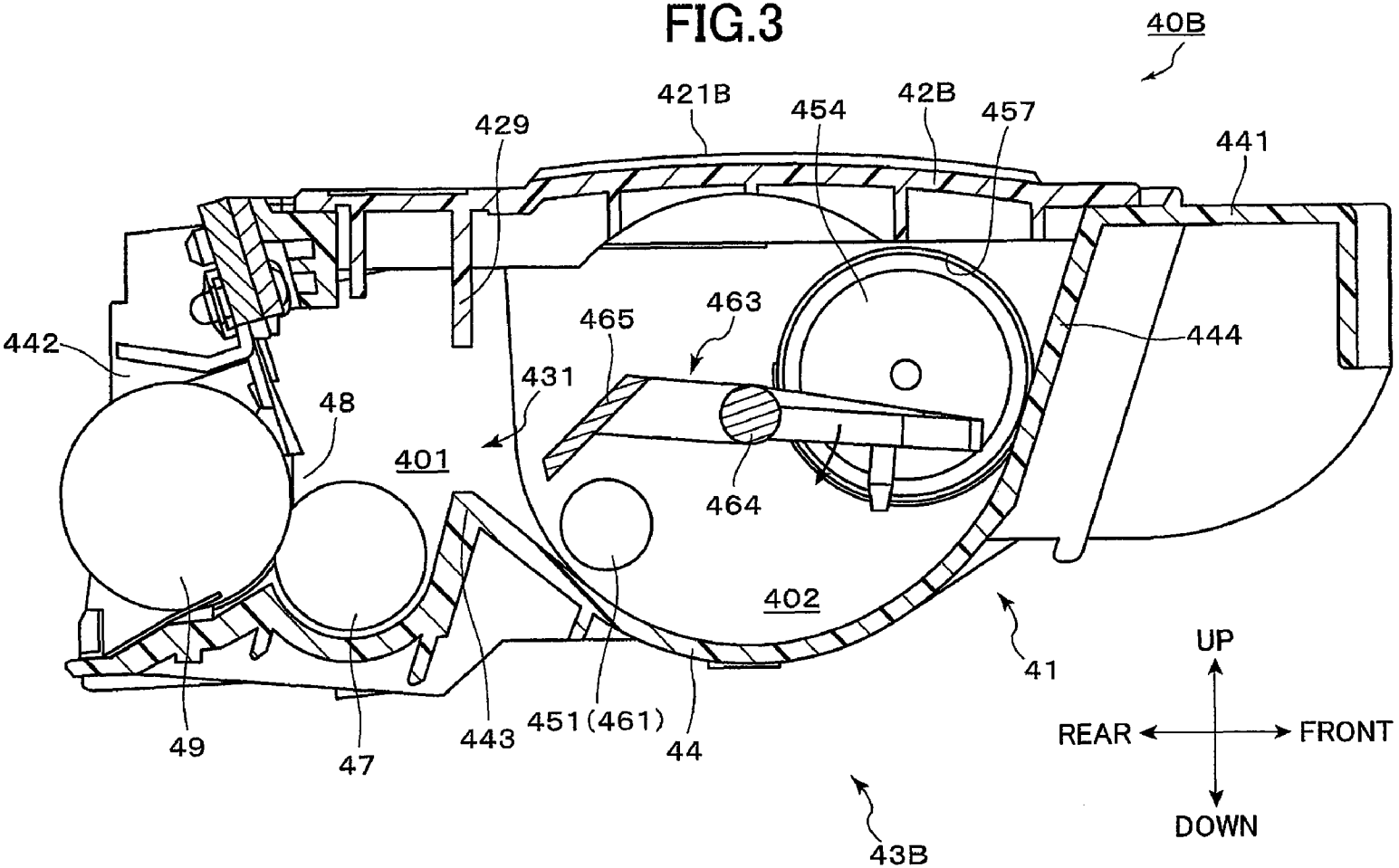
FIG. 3 is a cross-sectional side view of a normal cartridge.
Figure 6:
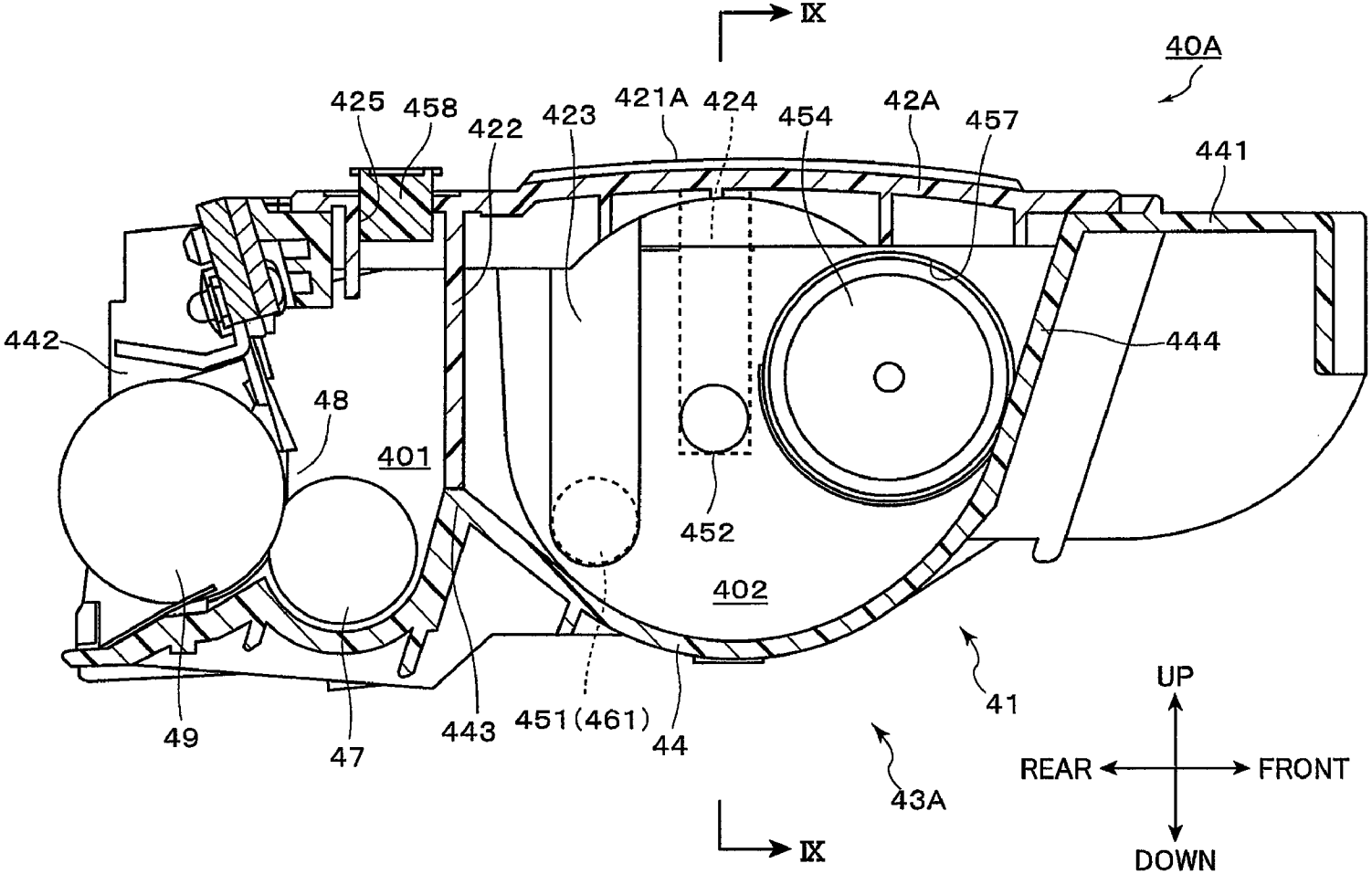
FIG. 6 is a cross-sectional side view of the starter cartridge.

Each of the normal cartridge 40B and the starter cartridge 40A includes a first chamber 401 and a second chamber 402. The normal cartridge 40B is shown in FIG. 3, while the starter cartridge 40A is shown in FIG. 6. As shown in FIGS. 3 and 6, a supply roller 47, a developing roller 49, a thickness-regulating blade 48, and a cap 454 are mounted in each of the normal cartridge 40B and the starter cartridge 40A.

When the process cartridge 20 having the normal cartridge 40B therein is mounted in the main casing 2 as shown in FIG. 1, the supply roller 47 rotates to supply toner accommodated in the first chamber 401 to the developing roller 49. At this time, the developer is positively tribocharged between the supply roller 47 and developing roller 49. A developing bias is also applied to the developing roller 49.

As the developing roller 49 rotates, the toner supplied onto the surface of the developing roller 49 passes beneath a pressing part of the thickness-regulating blade 48. The thickness-regulating blade 48 regulates the thickness of the toner carried on the surface of the developing roller 49 to a uniform thin layer.

As the photosensitive drum 91 rotates, the Scorotron charger 92 applies a uniform charge of positive polarity to the surface of the photosensitive drum 91. The charged surface of the photosensitive drum 91 is then exposed to a laser beam emitted from the scanning unit 19 and scanned at a high speed, forming an electrostatic latent image corresponding to an image desired to be formed on the paper 3.

Next, as the developing roller 49 rotates, the positively charged toner carried on the surface of the developing roller 49 comes into contact with the photosensitive drum 91. At this time, the toner is supplied to the electrostatic latent image formed on the surface of the photosensitive drum 91, i.e., regions of the uniformly charged photosensitive drum 91 that have been exposed by the laser beam and, therefore, have a lower potential. The supplied toner develops the electrostatic latent image into a visible image according to a reverse development process so that a toner image is carried on the surface of the photosensitive drum 91. It is noted that the operation the same as described is executed also when the process cartridge 20 having the starter cartridge 40A therein is mounted in the main casing 2.

Thereafter, the toner image carried on the surface of the photosensitive drum 91 is transferred onto a sheet of paper 3 by a transfer bias applied to the transfer roller 94 as the sheet is conveyed by the registration rollers 14 through a transfer position between the photosensitive drum 91 and transfer roller 94. After the toner image is transferred onto the paper 3, the paper 3 is conveyed to the fixing unit 50.

After the transfer operation, the cleaning brush 93 recovers paper dust deposited on the photosensitive drum 91 from the paper 3.

The fixing unit 50 disposed downstream of the process cartridge 20 includes a heating roller 52 and a pressure roller 51 disposed in confrontation with the heating roller 52. After toner is transferred onto the sheet of paper 3 at the transfer position, the fixing unit 50 fixes the toner to the sheet with heat as the sheet passes between the heating roller 52 and pressure roller 51. The heating roller 52 and pressure roller 51 continue to convey the sheet of paper 3 out of the fixing unit 50 and onto a discharge path 53 extending up toward the top surface of the main casing 2. Discharge rollers 54 disposed on the upper end of the discharge path 53 receive and discharge the sheet onto a discharge tray 55 formed on the top surface of the main casing 2.

Figure 4:
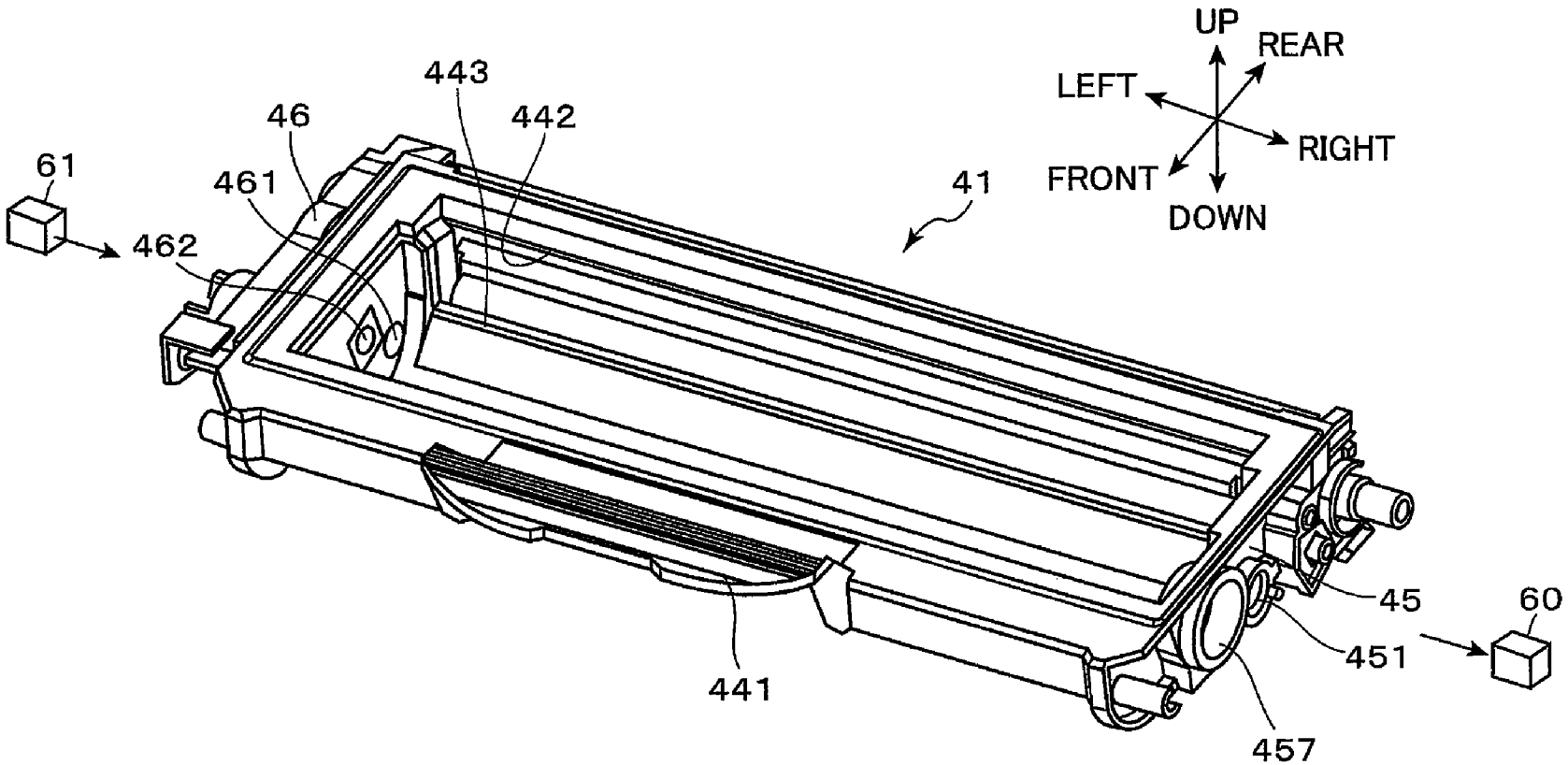
FIG. 4 is a perspective view of a lower frame that is used for both of the normal cartridge and a starter cartridge, and further illustrates the positional relationship between toner-detection windows formed in the lower frame and a light-emitting element and a light-receiving element, which are provided in the laser printer, when a cartridge having the lower frame is mounted in the laser printer.
Figure 5:
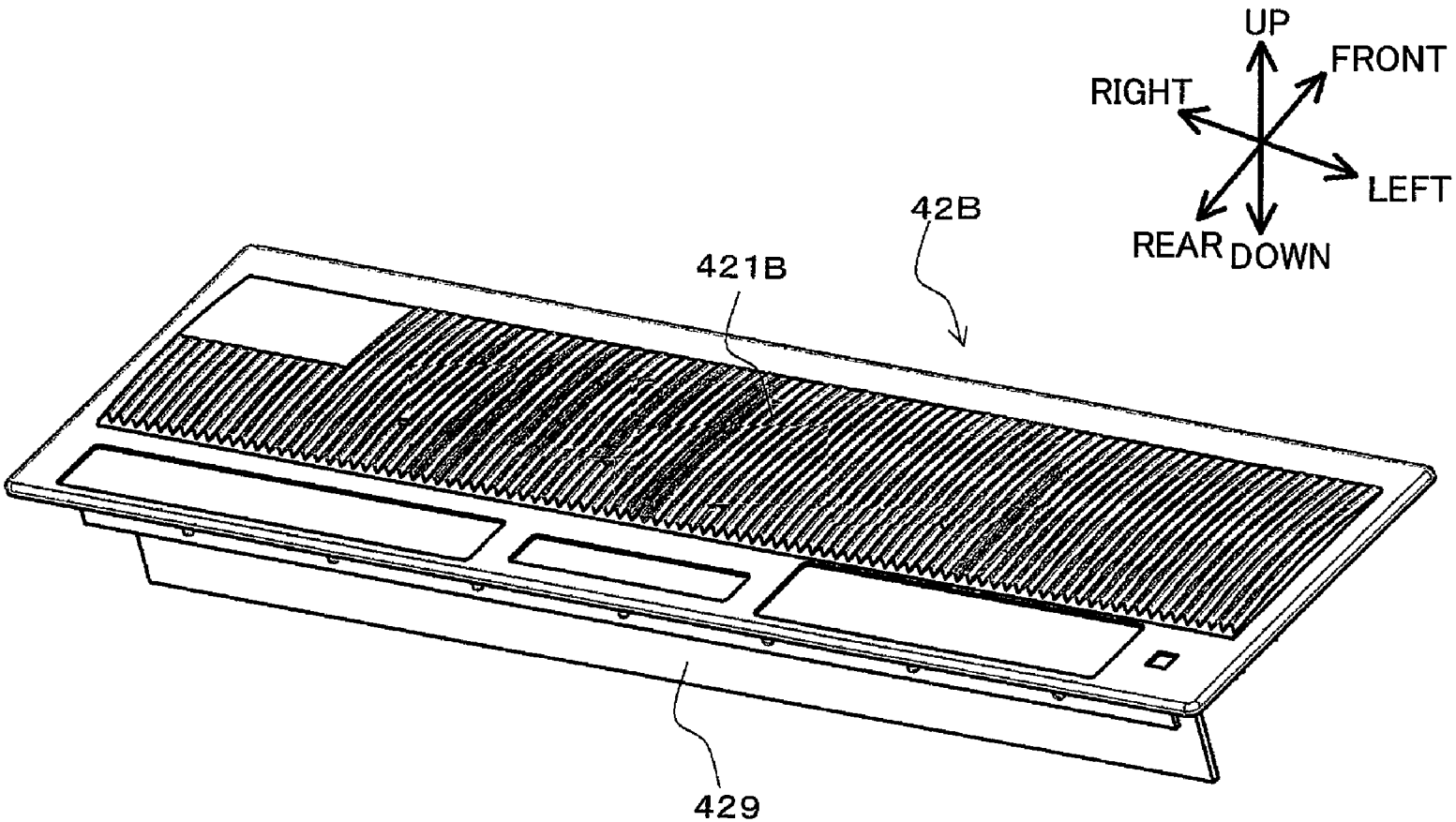
FIG. 5 is a perspective view of an upper frame for the normal cartridge.

Next, the structure of the normal cartridge 40B will be described with reference to FIGS. 3, 4, and 5.

As shown in FIG. 3, the normal cartridge 40B includes a lower frame 41 and an upper frame 42B that constitute a casing 43B. The supply roller 47, developing roller 49, and thickness-regulating blade 48 are disposed in the space formed in the casing 43B. An agitator 463 is also disposed in the space formed in the casing 43B.

The lower frame 41 is formed of a synthetic resin in a box-shape elongated in the left-to-right direction. As shown in FIGS. 3 and 4, the lower frame 41 includes a bottom wall 44, and a right wall 45 and left wall 46 extending upward from respective longitudinal ends of the bottom wall 44 so as to be in opposition to each other. The top side of the lower frame 41 opposite the bottom wall 44 is open, and an opening 442 is formed in the rear side of the lower frame 41. The bottom wall 44 has a protruding part 443 spanning between the right and left walls 45 and 46. The protruding part 443 protrudes upward at an intermediate position of the bottom wall 44 with respect to the front-to-rear direction (a direction orthogonal to the longitudinal direction).

The portion of the bottom wall 44 rearward of the protruding part 443 has partial cylindrical shapes that follow the outer surfaces of the supply roller 47 and developing roller 49. The portion of the bottom wall 44 forward of the protruding part 443 also has a partial cylindrical shape that follows the rotating path of the agitator 463. A front wall 444 rising upward from the front edge of the bottom wall 44 spans between the right and left walls 45 and 46. The top edge of the front wall 444 serves as a handle 441 that extends forward.

The space in the casing 43B, which is defined on the rear side of the protruding part 443 and in which the developing roller 49 is mounted, serves as the first chamber 401. In other words, the first chamber 401 is on a side near the developing roller 49. The space in the casing 43B, which is defined on the forward side of the protruding part 443 and on the far side from the developing roller 49, serves as the second chamber 402. The second chamber 402 is defined between the protruding part 443 and the front wall 444.

The supply roller 47 and developing roller 49 span between the right and left walls 45 and 46, and are supported by the right and left walls 45 and 46 at positions in the bottom region of the first chamber 401. The developing roller 49 contacts the rear side of the supply roller 47 and is compressed together with the same. The rear peripheral surface of the developing roller 49 is partially exposed through the opening 442. The developing roller 49 confronts and contacts the photosensitive drum 91 when the normal cartridge 40B is mounted on the drum cartridge 90. During a developing operation, a developing bias is applied to the developing roller 49. A driving force inputted from a motor (not shown) drives the developing roller 49 and supply roller 47 to rotate.

The thickness-regulating blade 48 includes a main blade member formed of a metal leaf spring member, and a pressing part provided on a distal end of the main blade member. The pressing part is formed of an insulating silicone rubber and has a semicircular cross section. The thickness-regulating blade 48 is supported by the lower frame 41 at a position above the developing roller 49 so that the pressing part is pressed against the developing roller 49 by the elastic force of the main blade member.

The upper frame 42B is also formed by molding synthetic resin. As shown in FIGS. 3 and 5, the upper frame 42B includes a plate-shaped cover part 421B, and a rib 429 spanning the cover part 421B in the longitudinal direction and projecting downward from the cover part 421B in a direction substantially perpendicular thereto.

The cover part 421B is formed in a rectangular plate shape and is mounted over the right and left walls 45 and 46 and the front wall 444 of the lower frame 41 so as to cover the open top of the lower frame 41. The cover part 421B may be attached according to one of various methods, such as adhesive bonding or ultrasonic welding. The rib 429 is positioned above and separated from the protruding part 443, forming a communication through-hole 431 between the rib 429 and the protruding part 443 that provides communication between the first chamber 401 and second chamber 402.

A first fill through-hole 457 is formed in the right wall 45 at a position corresponding to the second chamber 402 for introducing toner into the second chamber 402. The first fill through-hole 457 is sealed with the cap 454 at all times except when toner is introduced into the second chamber 402 through the first fill through-hole 457 when the normal cartridge 40B is manufactured.

The agitator 463 is mounted in the second chamber 402 and includes a support shaft 464, and a wiper 465 centered on the support shaft 464 and extending radially outward therefrom. A support through-hole 462 and a support depression or indentation 452 are formed in the left wall 46 and the right wall 45, respectively, at positions opposing each other in the right-to-left direction. The support through-hole 462 and support depression 452 are located in the second chamber 402. As indicated by a broken ling in FIG. 9, the support shaft 464 is supported with one end inserted into the support through-hole 462 in the left wall 46, and the other end inserted into the support depression 452 on the right wall 45. Both of the support through-hole 462 and the support depression 452 has a circular cross-section so as to be capable of rotatably supporting the support shaft 464.

The end of the support shaft 464 inserted into the support through-hole 462 protrudes outward the lower frame 41 and is coupled with a gear mechanism mounted in the housing of the laser printer 1. The agitator 463 rotates clockwise in FIG. 3 about the support shaft 464 when driven by the gear mechanism. As the agitator 463 rotates, the wiper 465 scrapes toner that has accumulated in the second chamber 402 on the bottom wall 44 and supplies some of the toner into the first chamber 401 via the communication through-hole 431. The toner that remains in the second chamber 402 without being supplied into the first chamber 401 is agitated by the wiper 465.

Residual toner detection windows 451 and 461 are respectively provided in the right and left walls 45 and 46 for detecting the quantity of toner remaining in the second chamber 402. The detection windows 451 and 461 are located in the second chamber 402. The detection windows 451 and 461 are formed of transparent material that is fitted into through-holes formed in the right and left walls 45 and 46 at positions opposing each other in the left-to-right direction. When a process cartridge 20 including the normal cartridge 40B described above is mounted in the main casing 2, the detection window 451 faces the light-receiving element 60 and the detection window 461 faces the light-emitting element 61 as shown in FIG. 4 so that the detection windows 451 and 461 are positioned along the optical path of the sensor light linking the light-emitting element 61 with the light-receiving element 60. The amount of residual toner in the second chamber 402 is detected by the light-emitting element 61 and light-receiving element 60 according to a method well known in the art.

Next, the structure of the starter cartridge 40A will be described with reference to FIGS. 6, 7, and 8.

The starter cartridge 40A is the same as the normal cartridge 40B except that an upper frame 42A is provided in place of the upper frame 42B and that the agitator 463 is not mounted in the starter cartridge 40A. In other words, the starter cartridge 40A includes the lower frame 41 and the upper frame 42A that constitute a casing 43A for the starter cartridge 40A. So, the starter cartridge 40A shares the lower frame 41 with the normal cartridge 40B. In addition, similarly to the normal cartridge 40B, the starter cartridge 40A is mounted with the supply roller 47, developing roller 49, thickness-regulating blade 48, and the cap 454. Accordingly, like parts have been designated with the same reference numerals.

Figure 7:
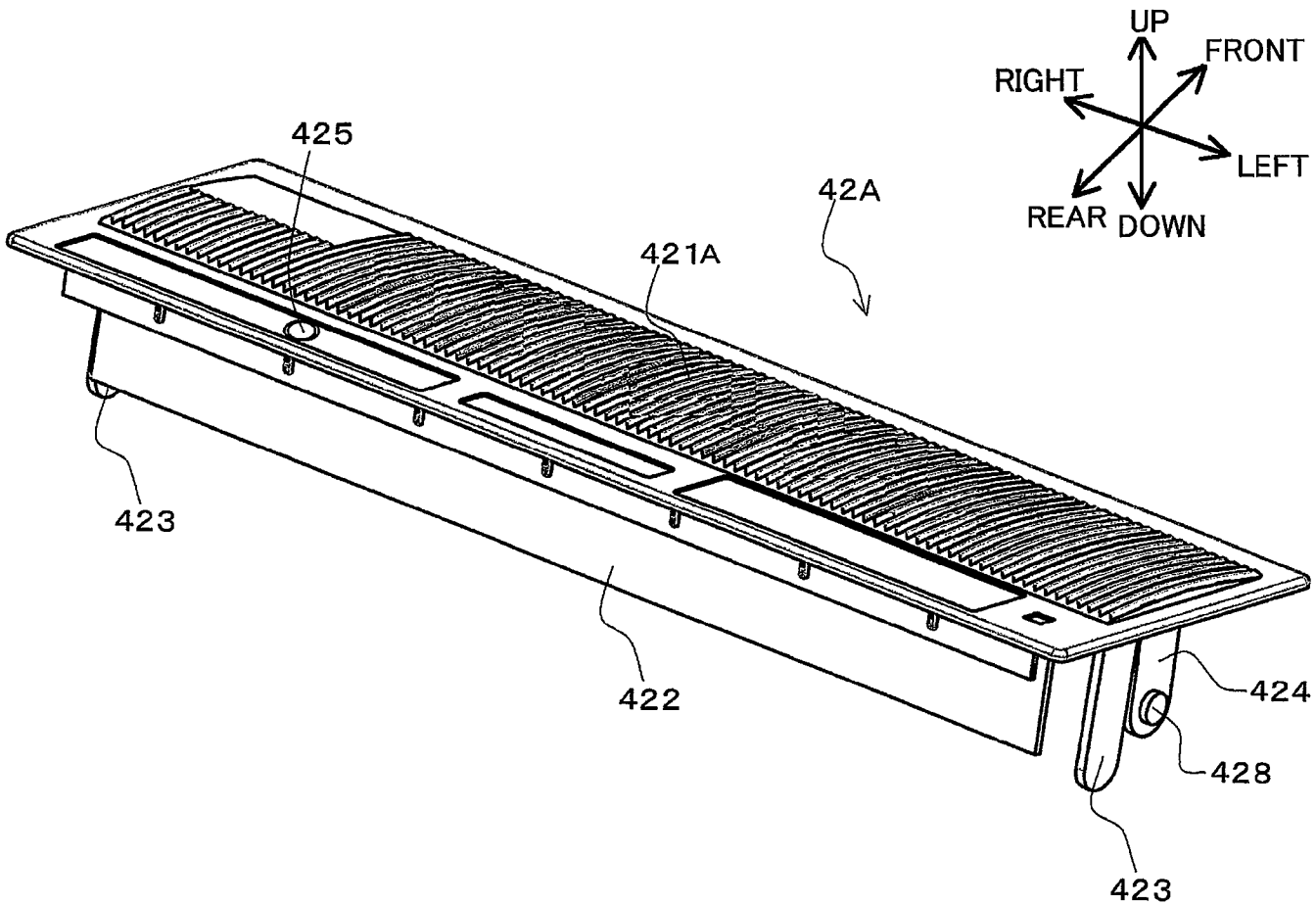
FIG. 7 is a perspective view of an upper frame for the starter cartridge.
Figure 8:
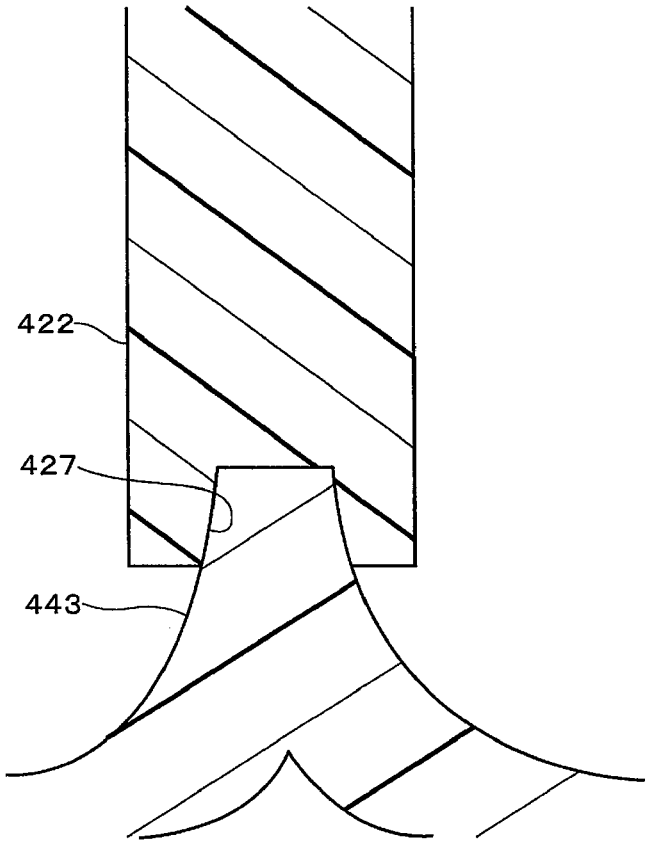
FIG. 8 is an enlarged cross-sectional side view of a portion of the starter cartridge, in which a partition and a protruding part is engaged with each other.

As shown in FIGS. 6 and 7, the upper frame 42A for the starter cartridge 40A has a cover part 421A and a partition 422 protruding downward from the cover part 421A in a direction substantially perpendicular to the cover part 421A so as to block the communication through-hole 431. The cover part 421A has the same shape with the cover part 421B of the normal cartridge 40B, and serves to cover the open top of the lower frame 41 in the same manner as the cover part 421B. Because the cover part 421A extends substantially in the horizontal direction when the starter cartridge 40A is mounted in the laser printer 1, the partition 422 extends substantially vertically when the starter cartridge 40A is mounted in the laser printer 1. The upper frame 42A further has a pair of light-shielding plates 423 and a sealing plate 424 that protrude downward from the cover part 421A in a direction substantially perpendicularly to the cover part 421A.

When the upper frame 42A is attached to the lower frame 41, the partition 422 contacts the protruding part 443 of the lower frame 41 as shown in FIG. 6. A recessed part 427 is formed in the distal end of the partition 422 for engaging with the distal end of the protruding part 443 as shown in FIG. 8.

Thus forming a recess on the distal end of the partition 422 increases the contact surface area of the distal ends of the partition 422 and the protruding part 443, ensuring that no gaps are formed in the area where the distal ends of the protruding part 443 and the partition 422 contact with each other. Further, fitting the protrusion into the recess ensures that the upper frame 42A is reliably fixed to the lower frame 41.

The partition 422 is also formed to contact both of the right and left walls 45 and 46. In other words, the partition 422 spans between the right and left walls 45 and 46. With the partition 422, the first chamber 401 is completely isolated from the second chamber 402.

A second fill through-hole 425 is formed in the cover part 421A at a position corresponding to the top of the first chamber 401 for introducing toner into the first chamber 401. The second fill through-hole 425 is disposed at a position adjacent to the partition 422 and substantially opposite the supply roller 47 and is sealed by a cap 458 at all times except when toner is introduced through the second fill through-hole 425 into the first chamber 401 when the starter cartridge 40A is manufactured. The second chamber 402 of the starter cartridge 40A is not filled with toner and remains empty. In other words, toner is not filled into the second chamber 402 through the first fill through-hole 457.

The pair of light-shielding plates 423 extend downward from the cover part 421A into the second chamber 402 to a position intersecting a line connecting both detection windows 451 and 461, thereby disabling the function of the detection windows 451 and 461.

Figure 9:
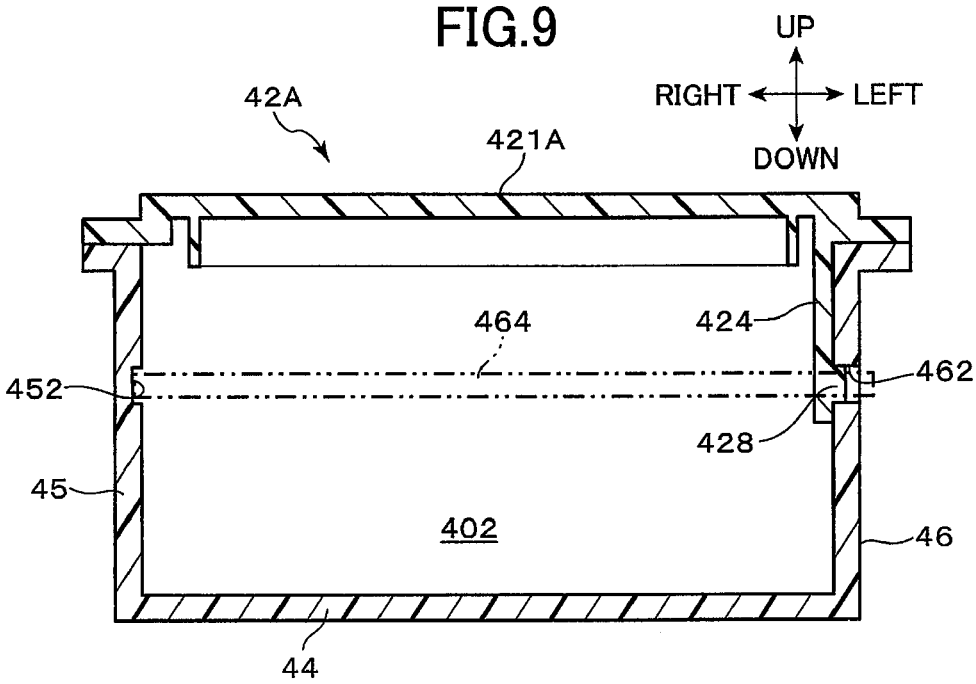
FIG. 9 is a cross-sectional view of the starter cartridge taken along a line IX-IX in FIG. 6.

As with the light-shielding plates 423, the sealing plate 424 extends downward from the cover part 421A into the second chamber 402 to a position confronting the support through-hole 462. As shown in FIG. 9, the sealing plate 424 has a sealing protrusion 428 that is fitted into the support through-hole 462 in the left wall 46 from the side surface of the sealing plate 424 opposing the left wall 46 in order to seal the support through-hole 462.

The starter cartridge 40A having the construction described above is premounted in the laser printer 1 before the laser printer 1 is shipped from the factory. In the starter cartridge 40A, the first chamber 401 is filled with toner, but the second chamber 402 is empty.

The type of toner accommodated in the starter cartridge 40A may be a polymer toner, for example. Polymer toner has substantially spherical particles, giving it excellent fluidity for producing high-quality images.

The starter cartridge 40A has substantially the same external shape with the normal cartridge 40B, and therefore has substantially the same entire capacity as the normal cartridge 40B. However, the starter cartridge 40A accommodates toner only in the first chamber 401, while the normal cartridge 40B accommodates toner both in the first and second chambers 401 and 402. The amount of toner filled in the starter cartridge 40A is smaller than that of toner filled in the normal cartridge 40B.

The partition 422 provided in the starter cartridge 40A can retain the small quantity of toner only at such a region that is near the supply roller 47 and developing roller 49, regardless of the overall capacity of the casing 43A. Accordingly, the toner can be quickly supplied onto the developing roller 49, reducing the startup time.

More specifically, now assume that the partition 422 were not provided in the starter cartridge 40A. In such a case, toner of a small amount will be accommodated in both of the first and second chambers 401 and 402. Accordingly, the starter cartridge 40A will require a longer time to supply toner to the developing roller 49 than the normal cartridge 40B whose first and second chambers 401 and 402 are filled with a larger amount of toner. Consequently, the startup time required for the starter cartridge 40A to begin supplying toner onto the developing roller 49 will become considerably long at the beginning of an image-forming operation.

Further, the polymer toner provided in the first chamber 401 is unlikely to enter the second chamber 402 due to the engagement of the protruding part 443 and the partition 422. Even in the unlikely event that polymer toner gets into the second chamber 402, the toner will not leak from the starter cartridge 40A since the support through-hole 462 is sealed by the sealing protrusion 428 of the sealing plate 424.

Further, since the starter cartridge 40A and normal cartridge 40B share the same lower frame 41, the exterior shape of both is substantially the same. Hence, both the starter cartridge 40A and normal cartridge 40B can be mounted in the same laser printer 1. Therefore, when the starter cartridge 40A premounted in the laser printer 1 at shipping runs out of toner, the same drum cartridge 90 can continue to be used while simply replacing the starter cartridge 40A with a normal cartridge 40B purchased commercially as a separate unit.

Further, by positioning the light-shielding plates 423 so as to intersect the line connecting the detection windows 451 and 461, the light-receiving element 60 does not detect light emitted from the light-emitting element 61 in the laser printer 1 when the starter cartridge 40A is mounted. Since the second chamber 402 of the starter cartridge 40A does not accommodate toner, a detection circuit for detecting residual toner in the second chamber 402 would determine that the laser printer 1 is out of toner if the light-receiving element 60 were to detect light. However, the light-shielding plates 423 prevent such an erroneous detection by blocking the sensor light. When using the starter cartridge 40A, the laser printer 1 may be configured to detect the amount of toner consumed by counting the number of sheets of paper or the amount of data subjected to image formation while the starter cartridge 40A is mounted.

Method of Manufacturing the Developing Cartridges

Next, a method of manufacturing the starter cartridge 40A and normal cartridge 40B will be described.

Figure 10:
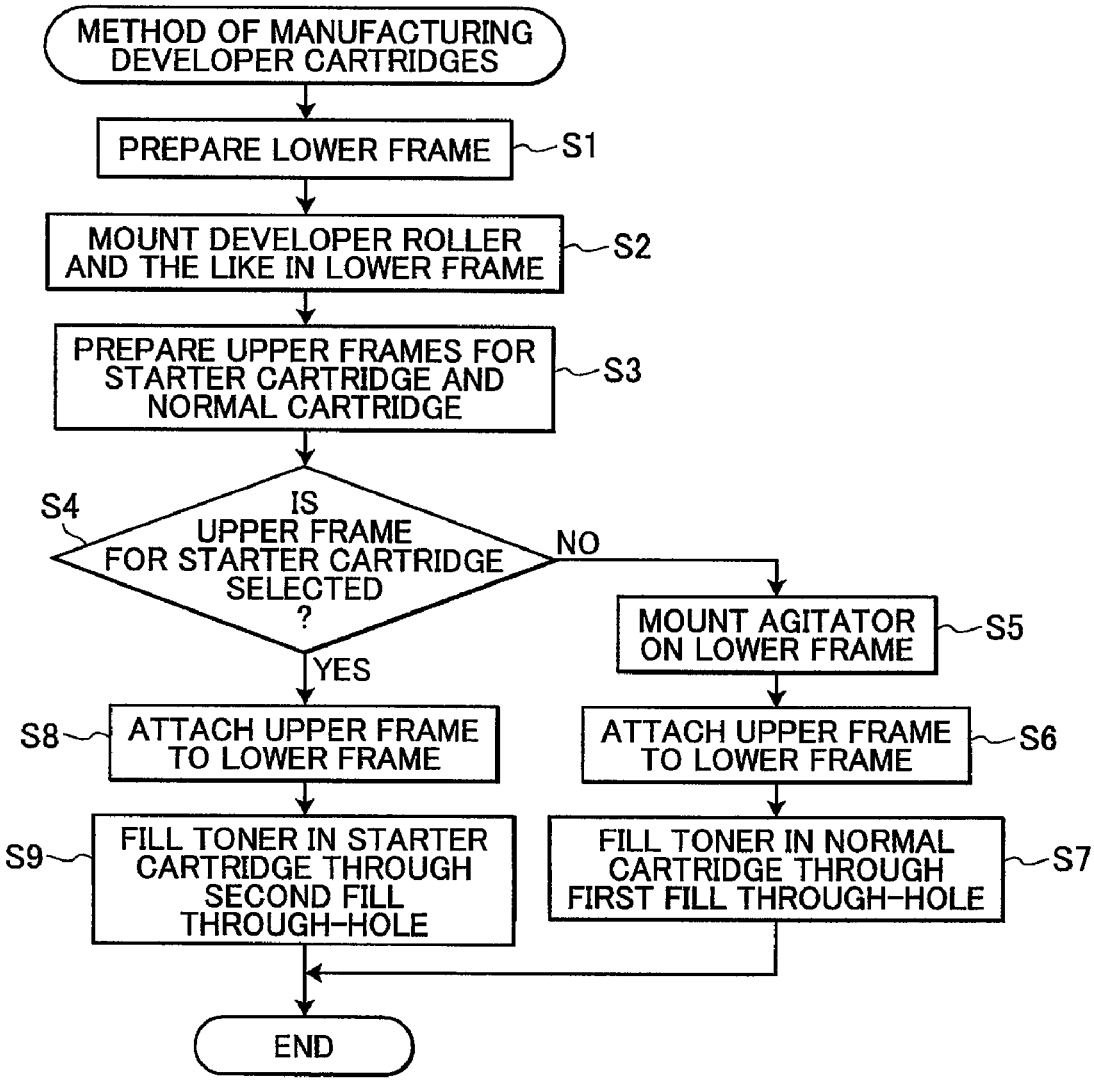
FIG. 10 is a flowchart of a process for manufacturing the developing cartridges.

FIG. 10 illustrates steps in the method of manufacturing a developing cartridge.

In S1 at the beginning of the process in FIG. 10, the lower frame 41 is prepared. A large number of lower frames 41 having the same shape can be mass-produced through resin molding.

In S2, the developing roller 49, supply roller 47, thickness-regulating blade 48, and the like are mounted in the lower frame 41 prepared in S1.

In S3 the upper frames 42A and 42B for both of the starter cartridge 40A and normal cartridges 40B are prepared. Manufacturing of the upper frames 42A and 42B are simplified because the upper frame 42A differs from the upper frame 42B in only the absence of the rib 429 and the presence of the partition 422, the light-shielding plates 423, and the sealing plate 424.

In S4 the manufacturer selects either one of the upper frames 42A and 42B, which are prepared in S3, as an upper frame to be mounted on the lower frame 41 that is prepared in S1.

If the manufacturer desires to produce a normal cartridge 40B and therefore selects the upper frame 42B for the normal cartridge 40B (S4: NO), in S5 the manufacturer mounts the agitator 463 in the second chamber 402 and in S6 mounts the upper frame 42B on the lower frame 41, thereby completing the casing 43B. In S7 toner is introduced through the first fill through-hole 457, completing construction of the normal cartridge 40B.

However, if the manufacturer wants to produce a starter cartridge 40A and selects the upper frame 42A for the starter cartridge 40A (S4: YES), in S8 the manufacturer mounts the upper frame 42A on the lower frame 41 and in S9 introduces toner through the second fill through-hole 425, thereby completing construction of the starter cartridge 40A.

By using a common lower frame 41 for manufacturing both the starter cartridge 40A and normal cartridge 40B in the process described above, manufacturing costs can be reduced, and the finished products will have the same external shape since they use a common frame. In the above process, the process of S3 for preparing the upper frame 42A and upper frame 42B may be included in the initial step of S1 for preparing the lower frame 41.

While the invention has been described in detail with reference to the specific embodiment thereof, it would be apparent to those skilled in the art that many modifications and variations may be made therein without departing from the spirit of the invention, the scope of which is defined by the attached claims.

The first fill through-hole 457 and second fill through-hole 425 of the starter cartridge 40A may both be formed in the right wall 45 at positions corresponding to the second chamber 402 and first chamber 401, respectively. Or, the first fill through-hole 457 and second fill through-hole 425 may both be formed in the left wall 46 at positions corresponding to the second chamber 402 and first chamber 401, respectively. Or, the first fill through-hole 457 may be formed in one of the right and left walls 45 and 46 at a position corresponding to the second chamber 402, and the second fill through-hole 425 may be formed in one of the right and left walls 45 and 46 at a position corresponding to the first chamber 401. Since no fill through-hole is formed in the upper frame 42A with this construction, the starter cartridge 40A and normal cartridge 40B can be formed with the same external shape.

Figure 11:
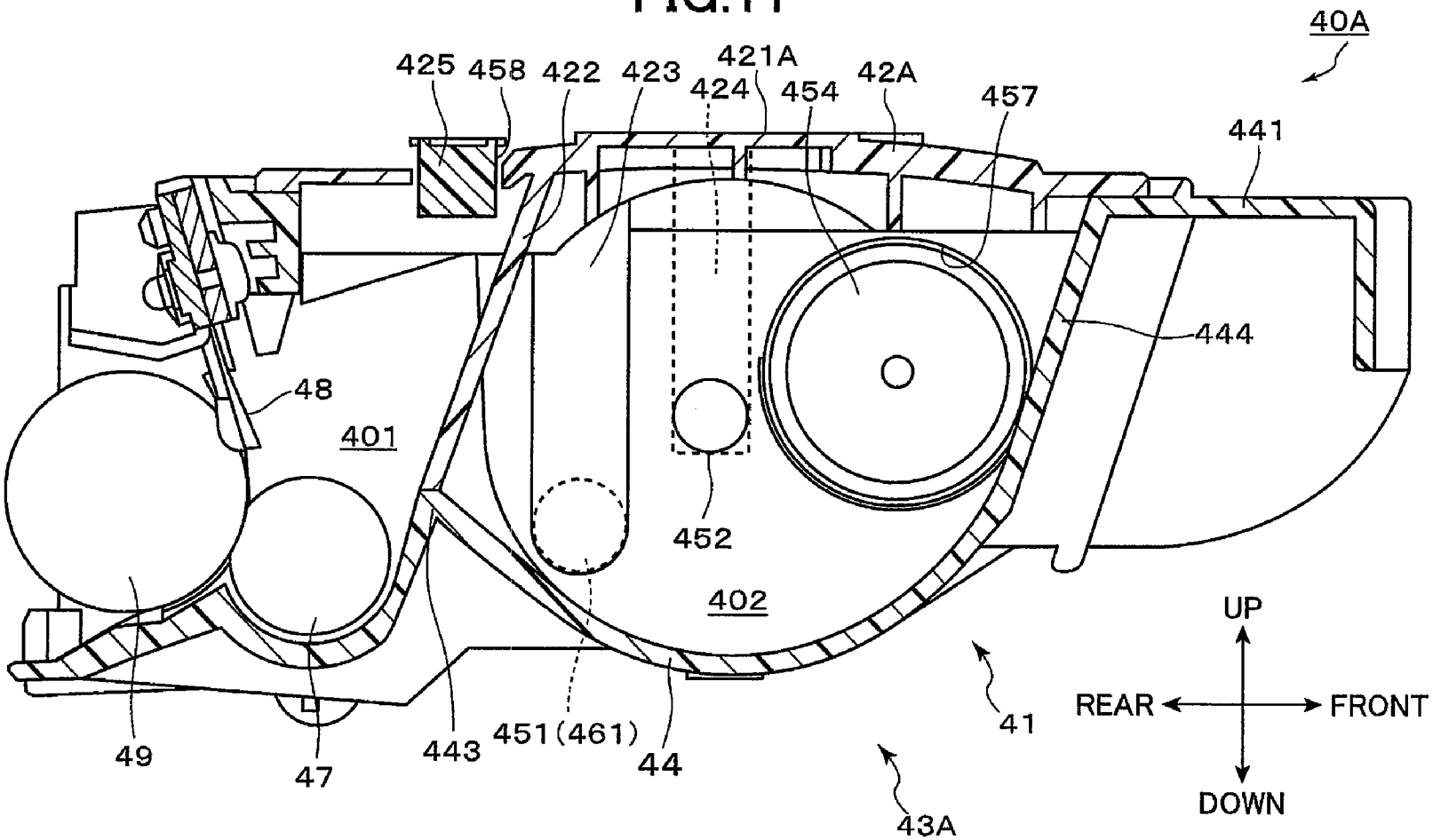
FIG. 11 is a cross-sectional side view of the starter cartridge according to a modification.

As shown in FIG. 11, the partition 422 may be disposed so as to slope downward toward the supply roller 47 and developing roller 49. Thus, the sloped top surface of the partition 422 faces the upper frame 42A in the first chamber 401. It is preferable that an angle in a range of about 0 to 45 degrees be formed between the partition 422 and an imaginary line that is perpendicular to the cover part 421A. Because the cover part 421A will extend substantially in the horizontal direction when the starter cartridge 40A is mounted in the laser printer 1, an angle in the range of about 0 to 45 degrees will be formed between the partition 422 and the vertical direction when the starter cartridge 40A is mounted in the laser printer 1. With this construction, toner accommodated in the first chamber 401 can slide down along the upper sloped surface of the partition 422 in a direction toward the developing roller 49, enabling toner to be more easily supplied to the developing roller 49. Further, by providing the second fill through-hole 425 at a position in the upper frame 42A opposite the sloped surface of the partition 422, toner introduced through the second fill through-hole 425 can easily slide along the sloped surface of the partition 422 in a direction toward the developing roller 49, particularly if the toner is polymer toner having good fluidity. Accordingly, this configuration can shorten the time required to supply toner for image formation.

In this modification, the partition 422 is entirely inclined relative to the cover part 421A. However, only the rear side surface of the partition 422 that faces to the rear may be inclined to slope downward toward the supply roller 47. The front surface of the partition 422 that faces to the front may extend substantially perpendicularly to the cover part 421A as in the embodiment.

Figure 12:
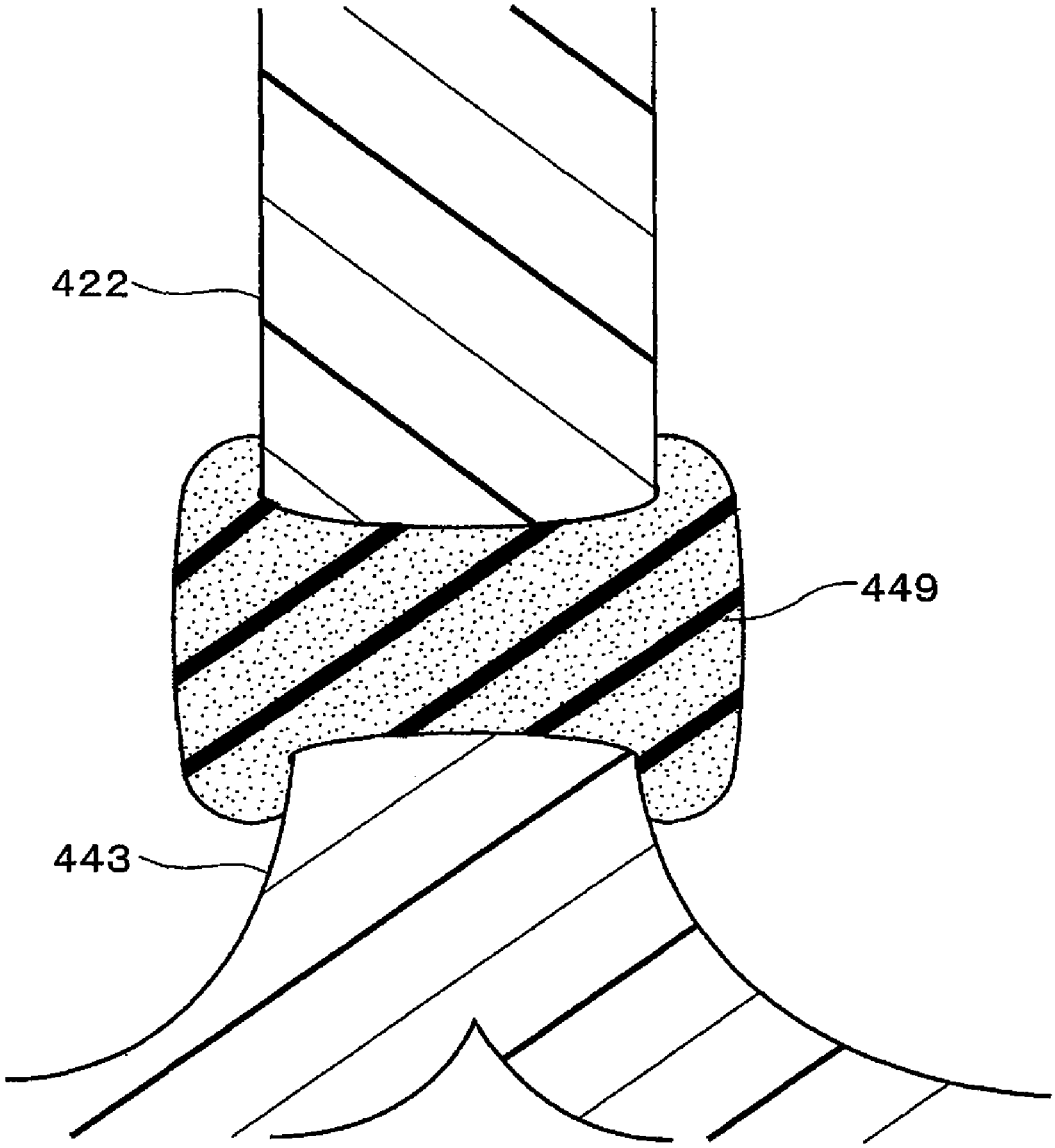
FIG. 12 is an enlarged cross-sectional side view of a portion of the starter cartridge according to another modification, in which a partition and a protruding part are connected with each other via a sealing member.

The partition 422 may not be formed with the recessed part 427, but a sealing member 449 such as a sponge may be interposed between the protruding part 443 and partition 422, as shown in FIG. 12, to hermetically seal the contact region of the protruding part 443 and partition 422. The sealing member 449 can prevent toner from leaking into the second chamber 402 through gaps between the protruding part 443 and the partition 422, which problem can lead to an increased startup time at the beginning of an image-forming operation required for supplying toner to the developing roller 49 or an insufficient amount of toner being supplied to the developing roller 49.

The sealing member 449 may also be included between the protruding part 443 and the partition 422, even when the recessed part 427 is formed on the partition 422 as described above in the embodiment.

Other methods of sealing the contact region between the protruding part 443 and the partition 422 to prevent toner leakage may be used, such as welding the partition 422 to the protruding part 443.

In the embodiment, the recessed part 427 is formed in the distal end of the partition 422. Instead, a recessed part may be formed in the distal end of the protruding part 443, and the distal end of the partition 422, which is in a protruding shape, may be engaged with the recessed part. In this case, a protrusion may be additionally formed on the distal end of the partition 422, and the additionally-formed protrusion be engaged with the recessed part. Even when the recessed part is thus formed on the protruding part 443, the sealing member 449 may be provided between the protruding part 443 and the partition 422. The partition 422 may be welded to the protruding part 443.

The protruding part 443 may not be formed on the bottom wall 44, but only a recessed part be formed on the bottom wall 44 for engaging with the distal end of the partition 422. A protrusion may be additionally formed on the distal end of the partition 422 and be engaged with the recessed part formed on the bottom wall 44. Even when the recessed part is thus formed on the bottom wall 44, the sealing member 449 may be provided between the partition 422 and the bottom wall 44. The partition 422 may be welded to the bottom wall 44.

Forming one of the bottom wall 44 and the partition 422 to have a protruding shaped part and the other to have a recessed part increases the contact surface area of the two, ensuring that no gaps are formed in the area where the bottom wall 44 and the partition 422 contact with each other. Further, fitting the protrusion into the recess ensures that the upper frame 42A is reliably fixed to the lower frame 41.

Further, any of the structures described in the embodiment and variations thereof may be suitably combined when constructing the starter cartridge and the normal cartridge. For example, the first fill through-hole 457, the support through-hole 462, or the support depression 452 may not be formed in the lower frame 41 for the starter cartridge 40A. In this case, the upper frame 42A may not be formed with the sealing plate 424.

While polymer toner is used in the embodiment, the present invention can be applied to a device using toner created according to other methods. Further, while the laser printer 1 according to the embodiment is a monochrome printer, the present invention may also be applied to a color laser printer.

In place of the starter cartridge 40A, the normal cartridge 40B may be mounted in the laser printer 1 before the laser printer 1 is shipped from the factory.

In the embodiment, the light-receiving element 60 is located on the side opposing the light-emitting element 61. However, the light-receiving element 60 may be located on the same side of the light-emitting element 61. In this case, the toner detection window 451 is omitted. The light-receiving element 60 is configured to be capable of receiving the sensor light that is reflected off the inner side surface of the right wall 45 of the lower frame 41 when toner does not exist in the second chamber 402.

At least one toner detection window may be formed through the upper frame 42B for the normal cartridge 40B. If the lower frame 41 is formed with no toner detection window, the upper frame 42A for the starter cartridge 40A need not be formed with the light-shielding plates 423.

A support portion for rotatably supporting the support shaft 464 of the agitator 463 may be formed through the upper frame 42B for the normal cartridge 40B. In this case, the lower frame 41 need not be formed with the support through-hole 462 and support depression 452. So, the upper frame 42A for the starter cartridge 40A need not be formed with the sealing plate 424.

The first fill through-hole 457 may be formed through the upper frame 42B for the normal cartridge 40B at a position corresponding to the second chamber 402. In this case, the lower frame 41 need not be formed with the first fill through-hole 457.

The upper frame 42A for the starter cartridge 40A may be formed with only one light-shielding plate 423.

Polymer toner may be stored also in the normal cartridge 42B.

What is claimed is:

1. A developing cartridge comprising:

a casing configured of a first frame and a second frame with a space formed therebetween; and a developer-carrying member that is supported in the first frame and that is configured to carry developer;

the first frame comprising a bottom wall and a pair of side walls erected from both sides of the bottom wall and having a box shape that is open on a side opposite the bottom wall;

the second frame being mounted over the pair of side walls so as to cover the open side of the first frame and having a partition extending into the space formed in the casing;

the partition contacting the bottom wall of the first frame and spanning between the pair of side walls of the first frame, thereby separating the space within the casing into a first chamber on a side near the developer-carrying member and a second chamber on a side far from the developer-carrying member, wherein only the first chamber is configured to accommodate developer.

2. A developing cartridge according to claim 1, further comprising a sealing member that is disposed between the partition and the first frame.

3. A developing cartridge according to claim 1, wherein a recessed part is formed on one of the partition and the bottom wall and the other of the partition and the bottom wall is formed to have a protruding part, and the protruding part is fitted into the recessed part.

4. A developing cartridge according to claim 1, wherein the partition is welded to the bottom wall.

5. A developing cartridge according to claim 1, wherein a first developer fill through-hole is formed in a part of the casing that forms the first chamber, developer being introduced in the first chamber through the first developer fill through-hole.

6. A developing cartridge according to claim 1, wherein the second frame has a main cover plate covering the open side of the first frame, the partition protruding from the main cover plate and having a sloped surface that is inclined with respect to the main cover plate to extend from the main cover plate in a direction toward the developer-carrying member.

7. A developing cartridge according to claim 1, wherein the bottom wall has a pair of first and second sides which are opposite to each other in a first direction and a pair of third and fourth sides which are opposite to each other in a second direction perpendicular to the first direction, wherein the pair of side walls are erected from the first and second sides of the bottom wall, the first frame further having a front wall that is erected from the third side of the bottom wall and that opposes the partition, the second chamber being located on a part of the bottom wall that is defined between the partition and the front wall, the first chamber being located on another part of the bottom wall that is defined between the partition and the fourth side, the developer-carrying member being located in the first chamber.

8. A developing cartridge according to claim 1, wherein the first frame is formed with an agitator support portion that is configured so as to be capable of supporting an agitating member, the agitator support portion being located in the second chamber.

9. A developing cartridge according to claim 1, wherein the first frame is formed with a window portion, through which light can pass, the window portion being located in the second chamber.

10. A developing cartridge according to claim 1, wherein the first frame is formed with a developer fill through-hole, through which developer can be filled into the second chamber.

11. A process cartridge, comprising an image cartridge;

an image-carrying member that is mounted in the image cartridge and that is configured so as to be capable of carrying an electrostatic latent image; and either one of a first developing cartridge and a second developing cartridge, each of which has a developer-carrying member that is configured so as to be capable of supplying a developer to the image-carrying member, the either one of the first developing cartridge and the second developing cartridge being selectively and detachably mountable on the image cartridge so that the developer-carrying member confronts the image-carrying member;

the first developing cartridge having a first casing, the second developing cartridge having a second casing, each of the first casing and the second casing defining a space therein, the space having a first chamber and a second chamber, each of the first casing and the second casing comprising a first frame, the first frame comprising a bottom wall and a pair of side walls erected from both sides of the bottom wall and having a box shape that is open on a side opposite the bottom wall, the developer-carrying member being supported by the first frame and being located in the first chamber, the first casing further comprising:

a second frame that is mounted over the pair of side walls so as to cover the open side of the first frame and that has a partition extending into the space, the partition contacting the bottom wall of the first frame and separating the first chamber from the second chamber, wherein only the first chamber among the first chamber and the second chamber of the first casing is configured to accommodate developer, the second casing further comprising:

a third frame mounted over the pair of side walls of the first frame to cover the open side of the first frame and to allow communication between the first chamber and the second chamber, wherein in both of the first chamber and the second chamber of the second casing are configured to accommodate developer, the second developing cartridge further comprising:

an agitating member that is provided in the second chamber of the second casing and that is configured so as to be capable of supplying developer from the second chamber to the first chamber.

12. A process cartridge according to claim 11, wherein the first casing is formed with a first developer fill through-hole through which developer can be introduced into the first chamber, developer being introduced into the first chamber of the first developing cartridge through the first developer fill through-hole; and wherein the second casing is formed with a second developer fill through-hole through which developer can be introduced into the second chamber, developer being introduced into the second chamber of the second developing cartridge through the second developer fill through-hole.

13. A process cartridge according to claim 11, wherein the first frame is formed with a support through-hole that is formed through one of the pair of side walls of the first frame and that is configured so as to be capable of rotatably supporting a rotational shaft of the agitating member; and the second frame further has a sealing piece that extends from the second frame into the second chamber and that seals the support through-hole.

14. An image-forming device comprising:

an image-forming device housing;

a light-emitting element that is mounted in the image-forming device housing and that is configured to emit a sensor light beam;

a light-receiving element that is mounted in the image-forming device housing and that is configured to receive the sensor light beam, an optical path of the sensor light beam being defined between the light-emitting element and light-receiving element;

an image-carrying member mountable in the image-forming device housing and that is configured so as to be capable of carrying an electrostatic latent image thereon; and either one of a first developing cartridge and a second developing cartridge that is selectively mountable in the image-forming device at a position intersecting with the optical path of the sensor light beam, each of the first developing cartridge and the second developing cartridge being configured to accommodate developer therein and including a developer-carrying member that is configured so as to be capable of being disposed in confrontation with the image-carrying member and supplying developer to the image-carrying member, the first developing cartridge having a first casing, the second developing cartridge having a second casing, each of the first casing and the second casing defining a space therein, the space having a first chamber and a second chamber, each of the first casing and the second casing comprising a first frame, the first frame comprising a bottom wall and a pair of side walls erected from both sides of the bottom wall and having a box shape that is open on a side opposite the bottom wall, the developer-carrying member being supported by the first frame and being located in the first chamber, a residual developer quantity detection window being formed through the first frame at a location forming the second chamber, the sensor light beam emitted from the light-emitting element reaching the residual developer quantity detection window when the each of the first and second developing cartridges is mounted in the image forming device, the first casing further comprising:

a second frame that is mounted over the pair of side walls so as to cover the open side of the first frame and that has a partition extending into the space, the partition contacting the bottom wall of the first frame and separating the first chamber from the second chamber, wherein only the first chamber among the first chamber and the second chamber of the first casing is configured to accommodate developer, a light-shielding member extending from the second frame to block the sensor light beam from reaching the light-receiving element, the second casing further comprising:

a third frame mounted over the pair of side walls of the first frame to cover the open side of the first frame and to allow communication between the first chamber and the second chamber, wherein both of the first chamber and the second chamber of the second casing are configured to accommodate developer.

15. The image-forming device according to claim 14, wherein the second developing cartridge further comprises an agitating member that is provided in the second chamber and that is configured so as to be capable of supplying developer from the second chamber to the first chamber.

16. A method of manufacturing a selected one of a first developing cartridge and a second developing cartridge that is selectively and detachably mountable in an image forming device, an image-carrying member being mounted in the image-forming device and that is configured so as to be capable of carrying an electrostatic latent image thereon, each of the first developing cartridge and the second developing cartridge being configured to accommodate developer therein and including a developer-carrying member that, when the each of the first developing cartridge and the second developing cartridge is mounted in the image-forming device, is disposed in confrontation with the image-carrying member and is configured so as to be capable of supplying developer to the image-carrying member, the first developing cartridge having a first casing, the second developing cartridge having a second casing, each of the first casing and the second casing defining a space therein, the space having a first chamber and a second chamber, each of the first casing and the second casing comprising a first frame, the first frame comprising a bottom wall and a pair of side walls erected from both sides of the bottom wall and having a box shape that is open on a side opposite the bottom wall, the developer-carrying member being supported by the first frame and being located in the first chamber, the first casing further comprising a second frame that is mounted over the pair of side walls so as to cover the open side of the first frame and that has a partition extending into the space, the partition contacting the bottom wall of the first frame and separating the first chamber from the second chamber, developer being accommodated in only the first chamber among the first chamber and the second chamber of the first casing, the second casing further comprising a third frame mounted over the pair of side walls of the first frame to cover the open side of the first frame and to allow communication between the first chamber and the second chamber, developer being accommodated in both of the first chamber and the second chamber of the second casing, the manufacturing method comprising:

mounting the developer-carrying member on the first frame;

mounting a selected one of the second frame and the third frame on the first frame; and introducing developer into the first chamber when the second frame is mounted on the first frame, thereby producing the first developing cartridge, and introducing developer into the second chamber when the third frame is mounted on the first frame, thereby producing the second developing cartridge.

17. The method according to claim 16, wherein an agitating member is mounted on the first frame if the third frame is mounted on the first frame, the agitating member being configured to agitate developer accommodated in the second chamber.

* * * * *